United States Patent [19]

Benedikter et al.

[11] Patent Number: 5,018,446

[45] Date of Patent: May 28, 1991

[54] INITIATING SENSOR

[75] Inventors: Richard Benedikter, Putzbrunn; Gunther Sepp, Ottobrunn; Wolfgang Knauer, Kienberg, all of Fed. Rep. of Germany

[73] Assignee: Messerschmitt-Bölkow-Blohm GmbH, Munich, Fed. Rep. of Germany

[21] Appl. No.: 477,590

[22] Filed: Feb. 9, 1990

[30] Foreign Application Priority Data

Mar. 21, 1989 [DE] Fed. Rep. of Germany ..... 3909188

[51] Int. Cl.[5] ..... F42C 13/02

[52] U.S. Cl. ..... 102/213

[58] Field of Search ..... 102/213

[56] References Cited

U.S. PATENT DOCUMENTS

| | | | |
|---|---|---|---|
| 3,242,339 | 3/1966 | Lee | 102/213 |
| 3,942,446 | 3/1976 | Cruzan | 102/213 |
| 3,942,447 | 3/1976 | Van Orsdel et al. | 102/213 |
| 4,185,560 | 1/1980 | Levine | 102/213 |
| 4,651,647 | 3/1987 | Baker | 102/213 |
| 4,903,602 | 2/1990 | Skagerlund | 102/213 |

*Primary Examiner*—Charles T. Jordan

*Attorney, Agent, or Firm*—Kenyon & Kenyon

[57] ABSTRACT

An initiating sensor for a missile equipped with a directional warhead. For the timely detection of the target and to calculate the tripping time, two rings are provided on the circumference of the missile, each having a multitude of active laser rangefinders.

6 Claims, 3 Drawing Sheets

INITIATING SENSOR

BACKGROUND OF THE INVENTION

The present invention relates to an initiating sensor for the warhead of a missile, which on its circumference has at least two ring-shaped configurations of several optical sensing elements, whose sensing regions open out conically in the flight direction.

These types of missiles are used to combat approaching enemy missiles. An initiating sensor for the warhead of a missile is disclosed in U.S. Pat. No. 3,942,446, which is supposed to produce a timely trip operation when flying past a target. For this purpose, the missile has four rings, each with several sensors, whereby the sensing regions of two sensors open out conically in the flight direction, while the sensing regions are arranged perpendicularly to the flight direction. Besides the high degree of complexity due to the four required sensor rings, it also appears to be disadvantageous that the speed of the target can only be detected after the sensing region of the last of the four sensor rings has been penetrated. Consequently, the application of such an initiating sensor for a warhead with an aimable directional capability is out of the question. Moreover, no references are made to the type of sensors used.

SUMMARY OF THE INVENTION

It is an object of the present invention to provide an initiating sensor for a warhead, so that it can be used both in the case of a warhead with an amiable capability and in the case of a fragmentation warhead.

The above and other objects of the invention are achieved by an initiating sensor for the warhead of a missile, which on its circumference has at least two ring-shaped configurations of several optical sensing elements, having sensing regions opening out conically in the flight direction, and wherein, on the circumference of the missile, the missile has two rings, each with a multitude of laser rangefinders, having sharply focused sensing regions opening out, diverging conically in the flight direction, the output signals of the laser rangefinders being fed to a computer, which, from the respective measured position and distance of the point of interception of the flight path of a target flying past and of the beam of a laser rangefinder, calculates the vector of the relative speed between the missile and the target and determines the tripping time from the position of the calculated point of intersection of this vector through the effective axis of the warhead, the axis being directed at the target flight path.

The special advantages of the initiating sensor according to the invention are its simple design and the fact that it is suitable both for warheads with a directionally aimable fragment distribution and for normal fragmentation warheads.

BRIEF DESCRIPTION OF THE DRAWINGS

The invention will be described in greater detail in the following detailed description with reference to the drawings, in which.

DETAILED DESCRIPTION

Figure 1:
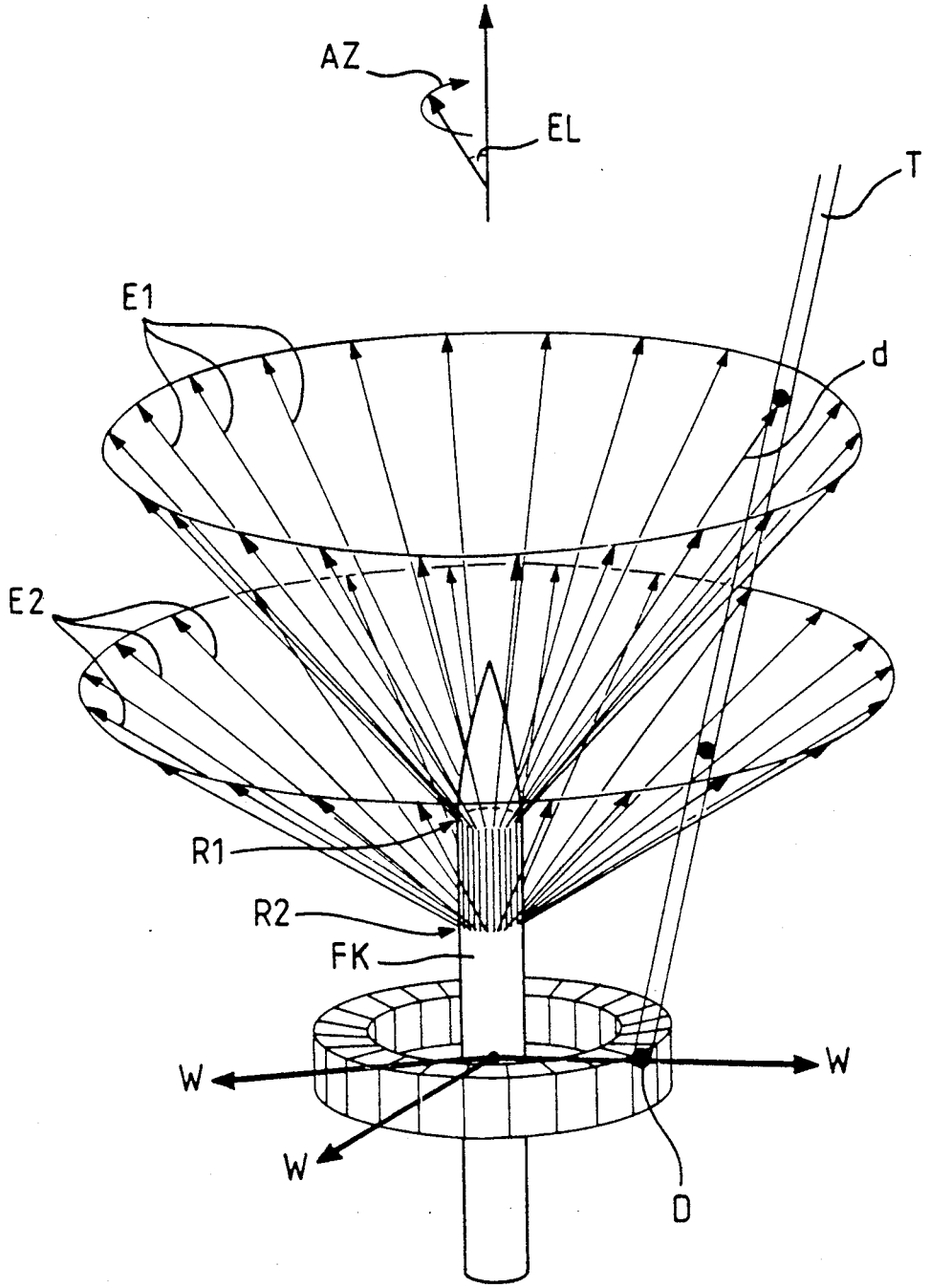
FIG. 1 shows an initiating sensor for combatting flying targets.

In a simplified version, FIG. 1 depicts the sensing regions E1, E2 and the sensor rings R1, R2, which encircle the jacket of the missile FK. The sensing regions E1, E2 open out conically in the direction of flight, whereby the rear sensor ring R2 has a somewhat larger beam or spread angle than the front sensor ring R1, so that the sensing regions do not intersect.

In the missile FK, a warhead (not shown) is arranged behind the sensor rings R1, R2. If a normal fragmentation warhead is employed, this warhead produces an equally distributed effect in all azimutal direction W. However, if a warhead with aimable directional capabilitY is used, then the effective axis W can be deliberately aimed to every direction in the plane shown in FIG. 1 over which the beams W span.

Each of the sensor rings R1, R2 consists of a plurality of individual, active laser rangefinders, disposed so that they extend over the sensing regions E1, E2 with evenly distributed individual beams.

Figure 4:
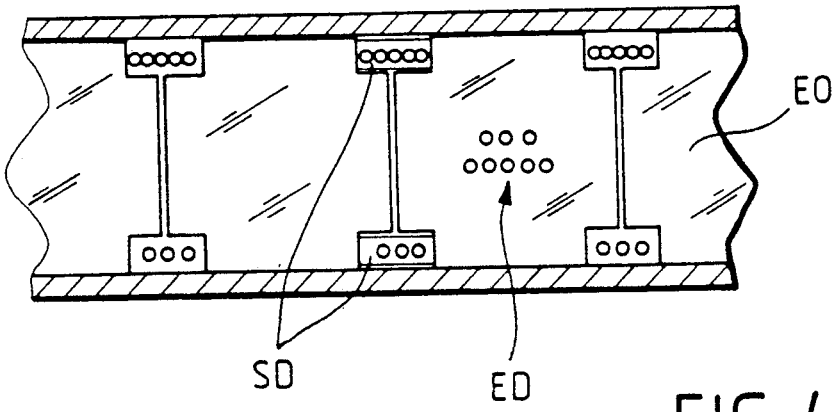
FIG. 4 shows a section of the sensor configuration.

Laser rangefinders are provided for the planned application which have a concentration of individual beams of less than 3 mrad of divergence. At a distance of 10 meters from missile, the reciprocal beam clearance amounts more or less to 30 centimeters. This results in 150 or 90 individual beams per sensor ring R1, R2. As discernible in FIG. 4, the transmitter laser diodes are constructionally combined in groups of 5 or 3 elements for each assembly. Between these groups of diodes, the shared optical detection systems EO are configured respectively for 5 or 3 receiving diodes ED. The transmitting diodes SD are prealigned to the carrier or base of the assembly. They are equipped with centering convergent lenses (so-called Selfoc lenses).

Figure 3:
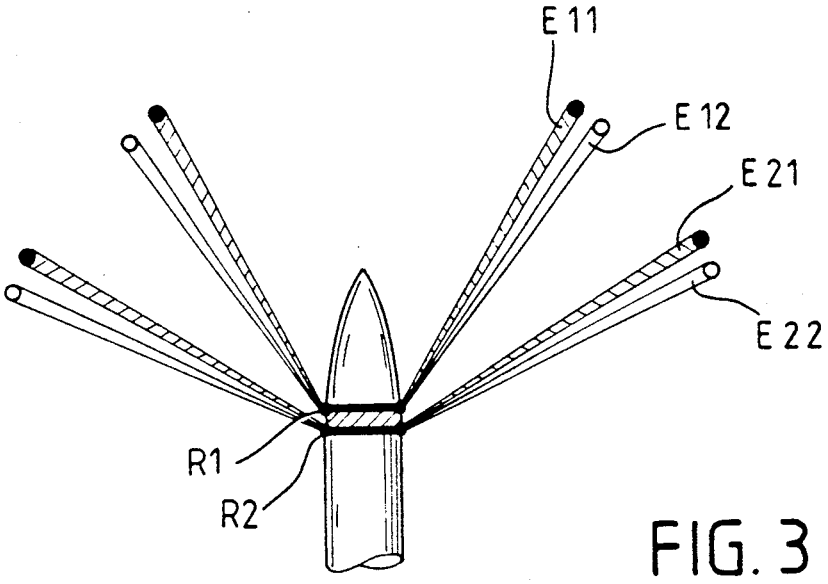
FIG. 3 shows a configuration of double-laser rangefinders.

When an especially good resolution is desired, the sensor rings R1, R2 can also have a double design, as depicted in FIG. 3, whereby the beams of the laser rangefinders are then aligned nearly parallel within each sensing region E1, E2.

According to another specific embodiment (not depicted) of the missile, the missile head can just as well-viewed in the flight direction-be arranged in front of the sensor rings R1, R2, since, in conjunction with the distance measurement, the forward-directed sensing regions E1, E2 allow the point of ignition to be calculated considerably earlier than had been possible in previously known specific embodiments of missiles.

Figure 2:
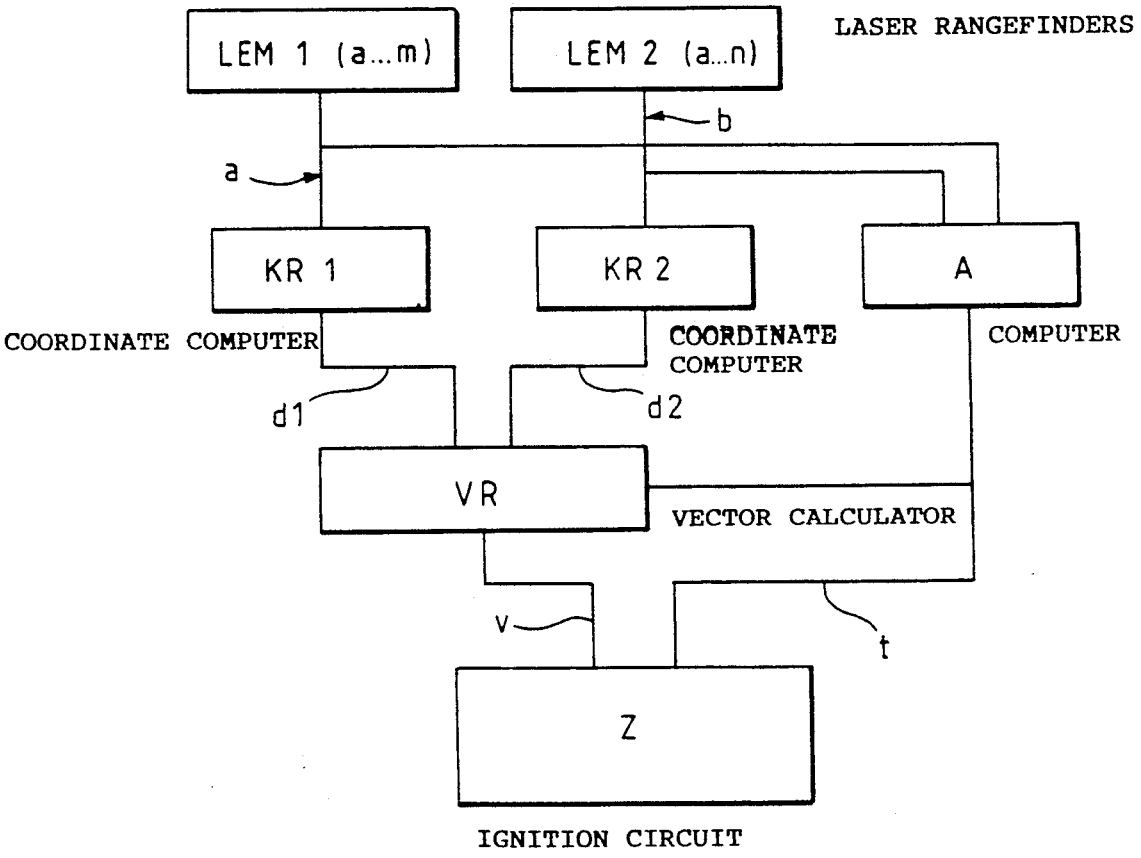
FIG. 2 shows a block diagram of the initiating sensor.

FIG. 2 depicts in simplified version the evaluation of the output signals a, b of the multitude of laser rangefinders LEM 1(a...m), LEM 2(a...n). When a target with the flight path T, as shown in FIG. 1, intersects or breaks through the sensing regions E1, E2, the laser rangefinders, whose beam strikes the target, produce output signals a, b. These signals are fed to the coordinate computer KR1, KR2 and to the part of the computer A which calculates the tripping time. The distances d1, d2 are calculated in the coordinate computer from the measured directions. Together with the time difference between the individual points of intersection through the sensing regions E1, E2, the distances d1, d2 reveal the flight path T of the target. Finally, taking into consideration the necessary pre-ignition time and the system-produced time delays, the optimum fazing time is determined in the firing or ignition circuit Z.

To simplify the signal processing, it is provided to combine the laser rangefinders into groups and to allow for an effective noise suppression in the case of the output signals of the open-circuited receiver. Finally, it is possible to couple the initiating sensor with the seeker head, which is present anyway in many missile, and to use its signals to switch on the initiating sensor when a target is approached. These signals can be used as well for the preliminary guidance toward the target flight path to be expected.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An initiating sensor for the warhead of a missile, the missile having a circumference having at least two ring-shaped configurations of several optical sensing elements disposed thereon, the sensing elements having sensing regions opening out conically in the flight direction, wherein:

the missile has two rings disposed on the circumference, each with a plurality of laser rangefinders having sharply focused sensing regions opening out and diverging conically in the flight direction;

the laser rangefinders providing output signals, the output signals being coupled to a computer for calculating from a respective measured position and distance of a point of interception of the flight path of a target flying past and of a beam of a laser rangefinder, a vector of the relative speed between the missile and the target and further for determining a tripping time from the position of the calculated point of intersection of the vector through an effective axis of the warhead, said axis being directed at the target flight path.

2. The initiating sensor recited in claim 1, wherein transmitter and receiver assemblies of at least two laser rangefinders are combined as groups.

3. The initiating sensor recited in claim 2, wherein at least the group of the receiver assemblies has a shared optical detection system.

4. The initiating sensor recited in claim 1, wherein in the direction of the sensing region of a ring of laser rangefinders, one further ring of laser rangefinders is provided respectively with nearly parallel sensing regions.

5. The initiating sensor recited in claim 1, wherein the received laser rangefinder signals are evaluated combined into groups.

6. The initiating sensor recited in claim 1, wherein the initiating sensor is switched to the ready position by a seeker head of the missile only when a target is approached.

* * * * *